US008459488B2

(12) United States Patent
Pannier, II et al.

(10) Patent No.: US 8,459,488 B2
(45) Date of Patent: Jun. 11, 2013

(54) PULL OUT DIVIDER SYSTEM

(75) Inventors: Donald Pannier, II, Geneva, IL (US); Shelley Nehrt, Barrington, IL (US)

(73) Assignee: Stack-On Products Company, Wauconda, IL (US)

( * ) Notice: Subject to any disclaimer, the term of this patent is extended or adjusted under 35 U.S.C. 154(b) by 174 days.

(21) Appl. No.: 13/038,700

(22) Filed: Mar. 2, 2011

(65) Prior Publication Data

US 2011/0215100 A1 Sep. 8, 2011

Related U.S. Application Data

(60) Provisional application No. 61/339,499, filed on Mar. 4, 2010.

(51) Int. Cl.

| | |
|---|---|
| ***B65D 21/02*** | (2006.01) |
| ***B65D 1/24*** | (2006.01) |
| ***B65D 25/04*** | (2006.01) |
| ***B65D 85/00*** | (2006.01) |

(52) U.S. Cl.

USPC ..... 220/528; 220/23.83; 220/23.87; 220/23.88; 220/500; 220/507; 220/523; 220/526; 220/527

(58) Field of Classification Search

USPC ..... 220/23.83, 23.87, 23.88, 23.89, 500, 220/507, 523, 526, 527, 528

See application file for complete search history.

(56) References Cited

U.S. PATENT DOCUMENTS

| | | | | |
|---|---|---|---|---|
| 5,344,024 | A * | 9/1994 | Cohu | 206/526 |
| 6,595,365 | B1 * | 7/2003 | Wigmore | 206/538 |
| 7,246,704 | B2 * | 7/2007 | Brunson et al. | 206/372 |
| 7,661,530 | B1 * | 2/2010 | Hewitt | 206/528 |
| 8,210,387 | B2 * | 7/2012 | Twig et al. | 220/521 |
| 2007/0272572 | A1 * | 11/2007 | Chen | 206/373 |

* cited by examiner

*Primary Examiner* — Anthony Stashick
*Assistant Examiner* — Madison L Poos
(74) *Attorney, Agent, or Firm* — Seyfarth Shaw LLP

(57) ABSTRACT

An organizer is provided. In one form, the organizer includes a storage container and at least one divider. The storage container has at least one outer wall and an opening defining an interior space. The at least one divider is sized to fit within the interior space. The at least one divider has a peripheral wall defining a storage space. An upper portion of the peripheral wall defines a divider opening. The at least one divider further includes at least one handle located adjacent the divider opening and extending inwardly towards the storage space.

13 Claims, 3 Drawing Sheets

Fig. 3
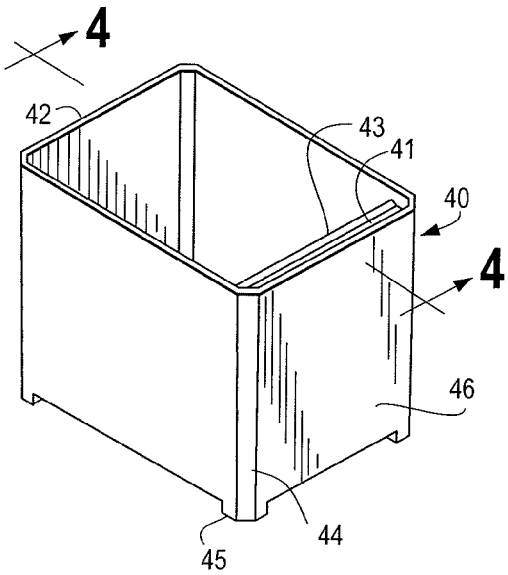
Fig. 5
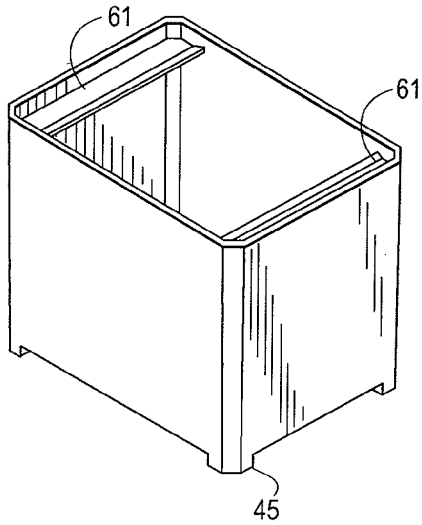
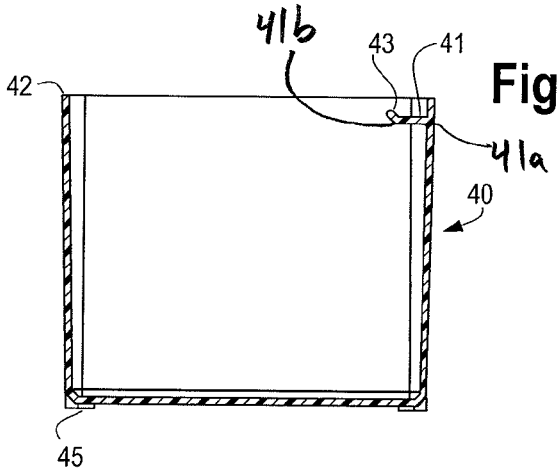
Fig. 4
Fig. 6
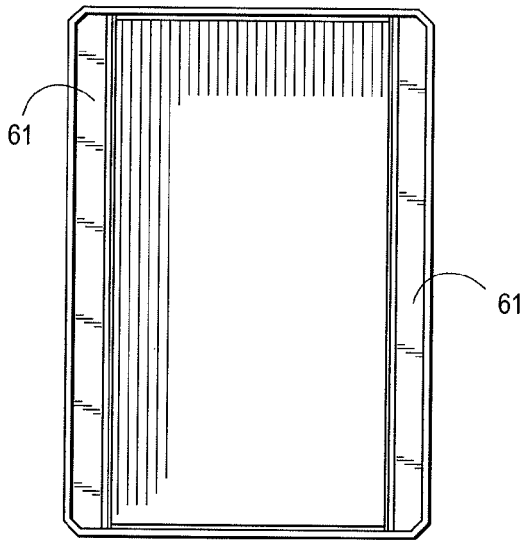

PULL OUT DIVIDER SYSTEM

CROSS-REFERENCE TO RELATED APPLICATION(S)

The present application claims the benefit of the filing date of co-pending U.S. Provisional Application No. 61/339,499, filed Mar. 4, 2010.

FIELD OF THE INVENTION

The present application relates to organizer systems. Particularly, the present application relates to an organizer system having dividers with internal handles

BACKGROUND

Portable organizers have been used for separating and storing a wide variety of items such as documents, parts, tools and equipment. In one form, storage cases have been developed as portable, transportable, hand held types of organizers that are made of light weight molded plastic. The organizer generally includes a handle for carrying, with a dual hinged clear plastic top that can be secured by two locking tabs on the handle side of the case.

Furthermore, a variety of different dividers or compartments have been developed to permit separation and organization of the contents. Moreover, it is often desirable to have removable dividers or compartments such that the contents of the dividers or compartments are easily accessible to the user.

Accordingly, there is a need for a pull out divider system for an organizer case permitting easy removal of the dividers from the organizer.

SUMMARY OF THE INVENTION

In accordance with an aspect, an organizer is provided. In one form, the organizer includes a storage container and at least one divider. The storage container has at least one outer wall and an opening defining an interior space. The at least one divider is sized to fit within the interior space. The at least one divider has a peripheral wall defining a storage space. An upper portion of the peripheral wall defines a divider opening. The at least one divider further includes at least one handle located adjacent the divider opening and extending inwardly towards the storage space.

In accordance with one form, the at least one divider includes two handles.

According to one form, the at least one divider further includes a plurality of feet.

In one form, the at least one divider includes four peripheral walls such that the at least one handle extends between two generally parallel peripheral walls and along further peripheral wall.

According to one form, the four peripheral walls form a generally quadrilateral shape having beveled corners.

These and other aspects of the application may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

FIG. 3 is a side perspective view of a form of a divider for use with the container of FIG. 2.

FIG. 4 is a cross-sectional side view of the divider of FIG. 3 taken along line 4-4 in FIG. 3.

FIG. 5 is a side perspective view of another form of a divider for use with the container of FIG. 2

FIG. 6 is a top plan view of yet another form of a divider for use with the container of FIG. 2.

DETAILED DESCRIPTION

Figure 1:
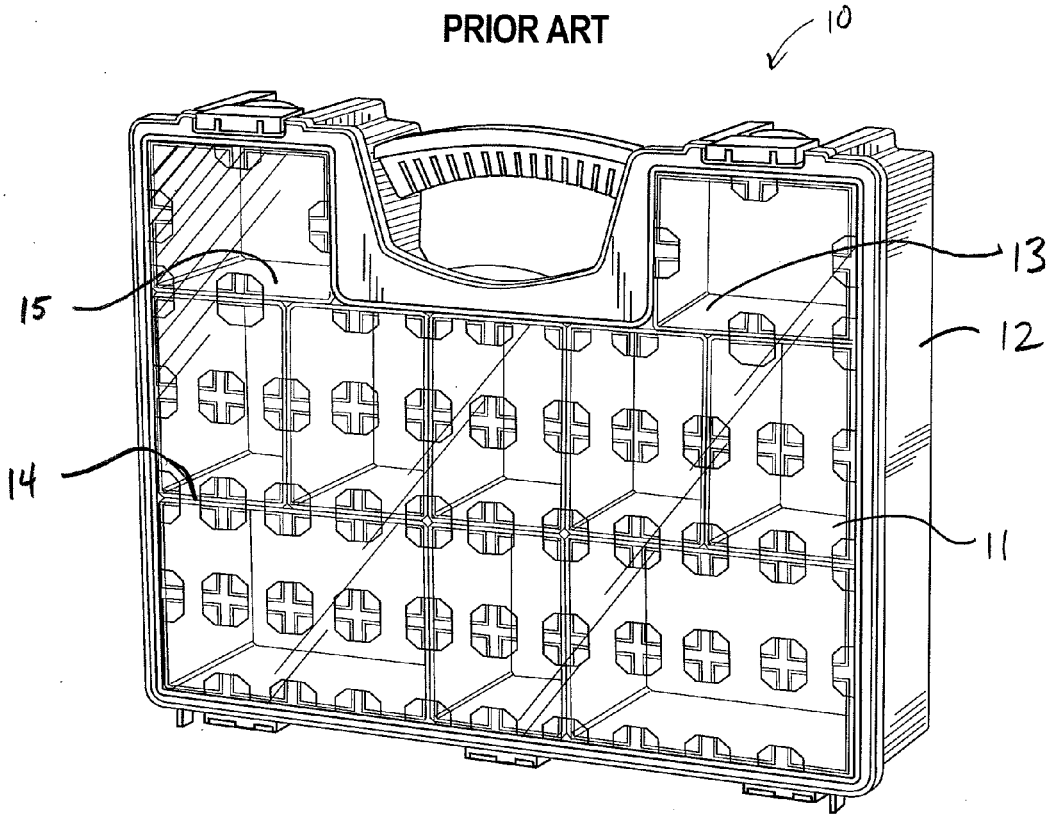
Fig. 1 PRIOR ART
FIG. 1 is a perspective view of a prior art organizer.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

Figure 2A:
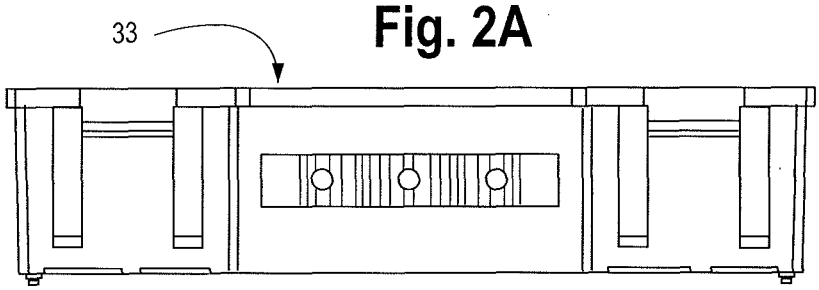
FIG. 2A is a side elevation view of the container of FIG. 2.
Figure 2:
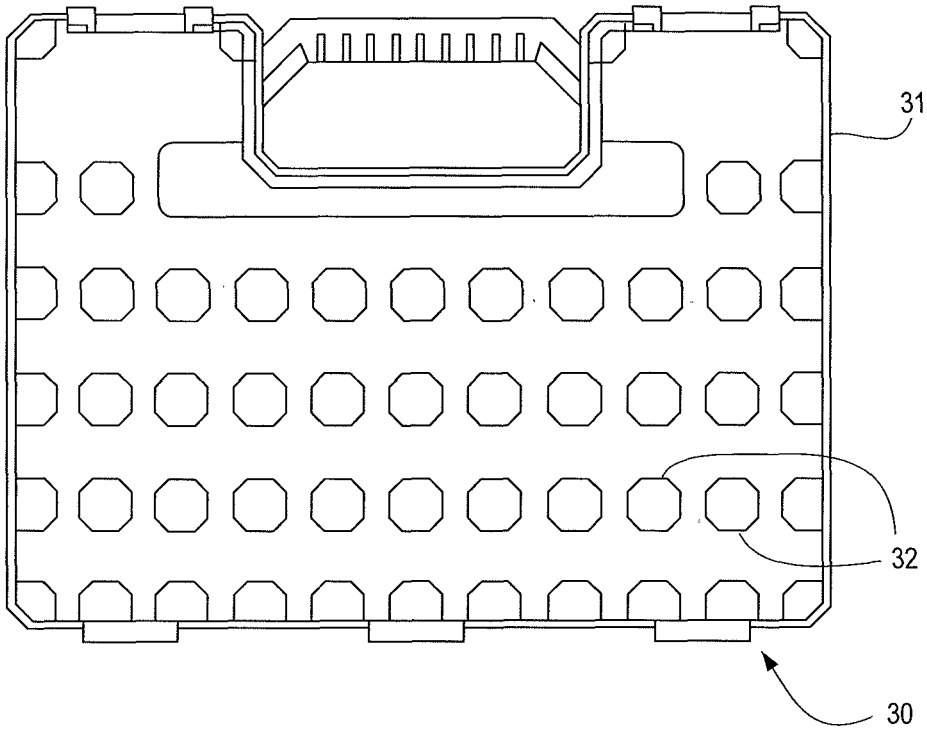
FIG. 2 is a top plan view of a container for an organizer of the present invention.

Referring to FIG. 1, there is illustrated a prior art portable storage container or organizer 10. The organizer 10 generally includes a lid 11 and a body portion 12 for containing a variety of dividers 13 or compartments used to separate contained items. The lid 11 may contain a plurality of cross-shaped grooves 14 for maintaining the walls 15 of the dividers in alignment Referring to FIGS. 2 and 2A, one form of the organizer 30 of the present application is shown. The body 31 of the organizer 30 includes a plurality of various sized divots 32 for helping retain the position of dividers (FIGS. 3-6) when inserted therein. In an embodiment, the feet 45 of a divider 40 may be inserted into the divots 32 to maintain alignment within the organizer 30. In one form, a transparent plastic top 33 allows visual identification of various items that may be stored in the organizer 30. The top 33 also assists in aligning dividers 40 of various sizes within the organizer 30, and not allowing the items stored in the organizer 30 to move from one individual divider to another.

As shown in FIGS. 3-6, the organizer 30 may include a plurality of removable (lift-out) dividers 40 of various sizes. Each divider 40 can fit in particular positions that fill the inner housing of the organizer 30, the feet 45 of the divider 40 capable of being inserted into the divots 32 of the organizer 30. In one form, each divider 40 has one or more handles 41 that assist in removing each divider 40 from the organizer 30. The location and number of handles 41 in each container may be modified as understood by those skilled in the art.

In one form, the number and location of the handles 41 can be determined by the weight of the items being stored in each divider 40. The addition of a handle 41 or multiple handles 61 within the divider 40 provides added strength the divider walls 46. Thus, the handles 41 not only permit easier removal but also provide greater strength and rigidity to the divider 40 for use with heavier items. In an embodiment, the handles 41 extend between two opposing walls 46.

The location, size, shape of other features may be modified as understood by those skilled in the art. For example, referring to FIG. 4, the handle 41 does not extend above the topmost surface 42 of the divider 40 so that it will not interfere with the lid 33 of the organizer 30. However, the position of the handle 41 may be modified as desired. In a form, the handle 41 includes a proximate end 41*a* adjacent to the peripheral wall 46 and a distal end 41*b* having a lip 43 at the end that is angled. The lip 43 further assists the user in grasping the handle 41 of the divider 40. Furthermore, it should be understood that the handle 41 does not need to extend the entire length of one of the walls 46 of the divider 40. Other modifications may be made as understood by those skilled in the art.

The edges 44 of the dividers 40 may also be beveled, radiused or the like. In one form, the beveled edges 44 aid in allowing air to enter and escape around the dividers 40 as the dividers 40 are removed and inserted into the organizer 30. Furthermore, the edges 44 may also aid in aligning the dividers 40 as they are removed and inserted into the organizer 30.

The dividers 40 may also include a number of additional features as understood by those skilled in the art. In a form, the dividers 40 may include a plurality of feet 45 to help maintain the dividers 40 in desired positions in the organizer 30. The feet 45 of the divider 40 may be capable of insertion into the divots 32 of the organizer 30.

It should also be understood by those skilled in the art that the dividers 40 may take a number of different shapes. For example, while illustrated generally as rectangular and square shaped in FIGS. 3-6, the dividers 40 may also be circular or other shapes. Additionally, various combinations of a variety of shapes may be incorporated into the system.

The organizer 30 and dividers 40 may be made from a variety of different materials as understood by those skilled in the art. In one form, the organizer and dividers are made from molded plastic.

While the invention has been described with respect to specific examples including presently preferred modes of carrying out the invention, those skilled in the art will appreciate that there are numerous variations and permutations of the above described systems and techniques that fall within the spirit and scope of the invention.

What is claimed is:

1. A storage organizer comprising:

a container having an outer wall and an opening defining an interior space; and a divider adapted to fit within the interior space including:

a peripheral wall defining a storage space, an upper portion of the peripheral wall defining a divider opening; and a handle disposed adjacent to the divider opening and extending inwardly towards the storage space, the handle including a first portion and a second portion disposed at an angle greater than zero relative to the first portion.

2. The organizer of claim 1, wherein the divider includes a plurality of feet.

3. The organizer of claim 1, wherein the divider includes a plurality of peripheral walls such that the handle extends between two opposing walls.

4. The organizer of claim 3, wherein the peripheral walls form a generally quadrilateral shape having beveled corners.

5. The organizer of claim 1, wherein the handle includes a proximate end adjacent to the peripheral wall and a distal end having the second portion.

6. A storage organizer comprising:

a container including a lid and a body portion having a side wall and a bottom wall;

a plurality of dividers respectively having walls defining an opening for receiving items to be stored and a handle extending inwardly from one of the walls, the handle having a first portion and a second portion disposed at an angle greater than zero relative to the first portion; and a plurality of divots disposed on the bottom wall of the container adapted to respectively receive the dividers.

7. The organizer of claim 6, wherein at least one of the dividers includes at least two handles.

8. The organizer of claim 6, wherein the handle includes a proximate end adjacent to one of the walls and a distal end having the second portion.

9. The organizer of claim 8, wherein the dividers each includes four walls such that the handle extends between two opposing walls with the proximate end extending along the one wall.

10. The organizer of claim 6, wherein at least one of the dividers includes a plurality of feet.

11. The organizer of claim 10, wherein the feet are received by at least one of the divots.

12. The organizer of claim 6, wherein at least one of the dividers is a quadrilateral.

13. The organizer of claim 6, wherein at least one of the dividers is rectangular.

* * * * *